United States Patent [19]

Reinertz

[11] Patent Number: 4,774,761

[45] Date of Patent: Oct. 4, 1988

[54] PROCESS FOR CHANGING ELECTRIC LINES IN ADDING ELECTRIC CONNECTORS AND A DEVICE FOR CARRYING OUT THE PROCESS

[75] Inventor: Rudolf Reinertz, Wuppertal, Fed. Rep. of Germany

[73] Assignee: Grote & Hartmann GmbH & Co., Fed. Rep. of Germany

[21] Appl. No.: 11,272

[22] Filed: Feb. 4, 1987

[30] Foreign Application Priority Data

Feb. 7, 1986 [DE] Fed. Rep. of Germany ..... 3603888

[51] Int. Cl.[4] ..... H01R 43/28

[52] U.S. Cl. ..... 29/857; 29/748; 29/759; 29/779

[58] Field of Search ..... 29/748, 759, 779, 785, 29/857, 865

[56] References Cited

U.S. PATENT DOCUMENTS 4,077,118 3/1978 McKeever ..... 29/749 X 4,616,396 10/1986 Matsui ..... 29/857 X

*Primary Examiner*—Howard N. Goldberg

*Assistant Examiner*—Taylor J. Ross

*Attorney, Agent, or Firm*—Jones, Askew & Lunsford

[57] ABSTRACT

This invention concerns a process for changing electric lines, especially for cutting a line to length and equipping cut line segments with electric connectors especially in an automatic cable finishing machine with lateral transport of the cut line segments with endless belts, where several different lines each unwound from a cable drum are stored on an arc of a circle, so they are parallel to each other with a certain distance apart and they are pivoted together on the arc of the circle for the purpose of changing the lines until a predetermined line is positioned at the culmination point of the arc. This invention also concerns a device for carrying out this process, characterized by a line storage device with support points for lines arranged on an arc extending across the transport direction of a line that is to be cut and arranged so they are spaced a certain distance apart, where the storage device is mounted so it can be pivoted back and forth in the direction of the arc.

39 Claims, 2 Drawing Sheets

PROCESS FOR CHANGING ELECTRIC LINES IN ADDING ELECTRIC CONNECTORS AND A DEVICE FOR CARRYING OUT THE PROCESS

This invention concerns a process for changing electric lines for cutting the lines to length and for equipping the ends with electric connectors. This invention also concerns a device for carrying out this process.

Electric line segments are usually finished in automatic cable finishing machines. First an electric line is unwound from a cable drum in longitudinal direction and cut to length, and the cut line segment is held with grippers in lateral transport in the automatic cable finishing machines and transported to a different processing station or the same station where the ends are insulated or crimped, for example.

For changing from one type of line to another, e.g., from a thinner line to a thicker line or from a black line to a blue line, there are changing devices in which the front end of the line is pulled back before the gripper of the cutting device and another line end is positioned in place. Such devices work satisfactorily with automatic cable finishing machines which have lateral conveyor grippers.

Recently, however, automatic cable finishing machines have been developed, which have lateral conveyor devices that operate much more rapidly than the lateral conveyor devices that have grippers on traditional automatic cable finishing machines. Such a high speed lateral conveyor device is described, for example, in DE-OS No. 3,212,542. This known lateral conveyor device has a first conveyor device which transports the line that is wound up on the cable drum in the direction of its longitudinal axis toward the cutting station. It also has a second conveyor device connected to the former which consists essentially of two parallel endless belts side by side which transport the cut line so it is held between the cable and so it is clamped at right angles to the longitudinal axis of the line and is transported to the processing stations. A channel is provided for transferring the line from the first conveyor device to the second conveyor device and is connected to the first conveyor system to which the line is conveyed in its longitudinal axis and which runs up to the second conveyor system. A slide reaches into the channel from the side facing away from the second conveyor system and pushes the line that is in the channel through a slit on the opposite side which opens as the slide advances between the belts of the second conveyor and it cuts the line with an appropriate cutting mechanism. To prevent the front end of the line of the next line segment which is cut off and remains in the cutting device from being deformed, the line end which is pivoted in cutting is guided in a sleeve which also pivots and swings the line end back again after cutting and positions it in such a way that it can be fed into the channel with no problem.

For this new type of automatic cable finishing machine, the known line changers work too slowly. Therefore, the purpose of the present invention is to create a process and an apparatus for such an automatic cable finishing machine so that lines can be changed very rapidly, and the device should especially have a high storage capacity for different lines.

This invention is explained in greater detail below on the basis of the illustrated example of a line changer shown in the diagram.

Figure 1:
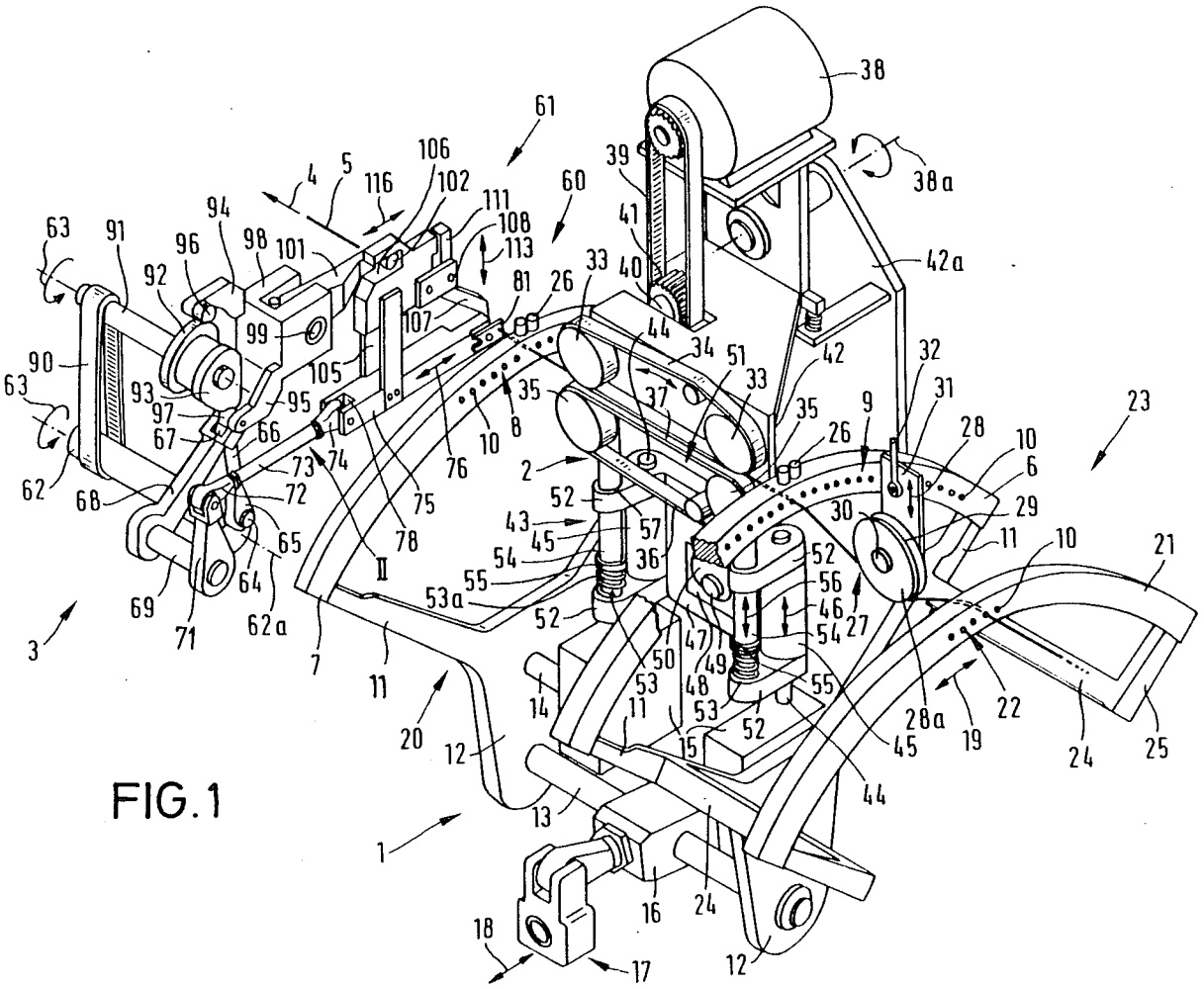
FIG. 1 shows a perspective view of a line changer according to this invention.

The line changer essentially has a pivotable storage device 1 and a transport device 2 as well as subordinate cutting device 3.

The pivotable storage device 1 consists of at least two equal convex beams 6 and 7 that project upward and are positioned one after the other in the transport direction 4 of line 5 forming a space 20, and one row 8, 9 of holes is provided in each beam with continuous holes 10 extending in transport direction 4 and arranged a certain lateral distance apart on a circle, and the holes 10 of row 9 are aligned with holes 10 of row 8, and all holes 10 preferably have the same diameter. One supporting arm 11 is provided at each free end of beams 6 and 7, and the supporting arms 11 of a beam 6 or 7 are arranged in a V shape converging at the bottom and with a pivot arm 12 that projects downward. In the free lower end area, the pivot arms 12 are connected to each other by means of a horizontally positioned pivot axle 13 that is mounted in the end areas so it can rotate. At some distance perpendicularly above pivot axle 13, there is a short bearing axle 14 that runs parallel to pivot axle 13 and is mounted in a stationary bearing foundation 15 so it can rotate.

Pivot axle 13 passes through a block 16 in such a way that it can rotate, and said block is connected to a coupling 17 where a driving mechanism (not shown) acts, creating movement in the direction of double arrow 18, so a pivot movement in double arrow directions 19 about bearing axles 14 is transmitted to storage device 1.

According to a special version of this invention, another beam 21 of the same design forming an interspace with some distance likewise has continuous holes 10 arranged on a circle in a row 22 of holes and a support 24 running parallel to the transport direction 4 is provided on each supporting arm 11 at the same location on each arm such that a short supporting arm 25 is bent upward at right angles at the free end and sits on the free end of curved beam 21.

Lines of various types are drawn through holes 10, but only one line 5 is illustrated which is handled by the cutting device (not shown) of an automatic cable finishing machine (likewise not shown). Line 5 projects forward substantially beyond beam 7 in transport direction 4. All the other lines that are not shown stop at the respective hole 10 of beam 7 so they do not project out of it.

Beams 6 and 7 are equipped with clamping devices for each hole 10. A clamping device may have a bolt 26, for example, that is mounted in beam 6 or 7 and projects from above or below into a hole 10. With suitable devices, the bolt is pressed against the respective line so it is clamped. After stopping the clamping, the line can be drawn freely through holes 10. The means for carrying out and controlling the movement of bolts 26 are not shown in the figure.

Beam 21 does not have any clamping device. Instead, a loop-forming device 27 is provided in or above the interspace 23 in the area of the culmination of the circle and can be moved up and down in the direction of double arrows 28 with driving mechanisms (not shown), and in the down position it presses against the line that is clamped in beam 6 and is under the loop-forming device 27, pulls it through hole 10 of beam 21, forming a loop in interspace 23 and is unwound from the cable roll (not shown). After forming a loop, the loop-forming device 27 travels upward again. The loop-forming device 27 in the example shown here has a rotating wheel 28 whose running surface 29 is wedged and whose axle 30 is horizontal and at right angles to the transport direction 4 of line 5, namely on a supporting plate 31 on which there is a drive coupling element 32 which is connected to a drive mechanism (not shown). The purpose of forming the loop is explained below.

The transport device 2 is arranged in the interspace 20 between beams 6 and 7. It consists essentially of an upper endless transport belt 34 that is guided over rolls 33 beneath which there is another endless transport belt 36 that is guided over rolls 35. The lower line of the transport belt 34 forms a gap 37 with the upper line of the transport belt 36. Transport belts 34 and 36 are aligned in the transport direction 4 and the gap 37 is in the plane of the given line 5 that is to be cut to length. The thickness of gap 37 is variable and corresponds to the thickness of this line during transport of line 5.

According to this invention, the upper transport belt 34 as well as the lower transport belt 36 are designed so they can be driven at the same speeds. For example, a motor 38 drives a gearwheel 41 that sits on the axle 40 of a roll 33 by way of a toothed belt 39, and the axles 40 of rolls 33 are mounted in a vertical bearing plate 42 at the side of rolls 33. The combination of toothed belt drive with motor and bearing plate 42 with the upper transport belt arrangement 33, 34 is mounted so it can swing about axle **38*a* which is mounted horizontally in foundation plate 42*a* so a uniform pressure per unit of area can be achieved along the entire length of the toothed belts and fluctuations in thickness of the lines can be equalized. With another gearwheel (not shown) on one of axles 40 so that it engages a gearwheel (not shown) that sits on one of the axles of rolls 35, the drive is transferred to the lower transport belts 37** in a known way.

According to another feature of this invention, the rolls 35 of the lower transport belt 36 are mounted on a mounting device that is independent of the mount of rolls 33 of the upper transport belt 34 and is connected to a lifting device 43 and can be run up and down in the double arrow direction 46. This lifting device 43 may consist of two vertical columns 44 that are arranged so they are spaced some distance apart and are parallel at a certain distance from transport belts 36 and are secured in one of the bearing foundations 15. Columns 44 each pass through a line guide sleeve 45 which are connected to each other by way of a connecting plate 47 forming a lifting carriage 51. A hole 48 is provided in connecting plate 47 and a cam 50 that is driven by a horizontal axle 49 rests in this hole. The drive is not shown. The hole 48 and cam 50 are coordinated in terms of spatial dimensions in such a way that a rotational movement of cam 50 causes an up and down movement of the lifting carriage 51. There is one bearing arm 52 running from each guide sleeve 45 up and down parallel to each other in the direction of transport belt 36. In the free end area of each lower bearing arm 52, there is mounted a vertical column 53 over which sleeve 54 is inverted in a form-fitting manner like a telescope and has a ring-shaped collar 55 at the lower end. Between collar 55 and the lower bearing arm 52, there is a spiral compression spring **53*a* on column 53 in such a way that sleeve 54 can be moved in the direction of double arrows 56. Each sleeve 54 passes freely and in a form-fitting manner through hole 57 in upper bearing arm 52, and the axle of a roll 35** (not shown) is mounted at the upper free end of each sleeve.

When lifting carriage 51 is moved downward, it takes sleeves 54 and thus rolls 35 and belts 36 with it and gap 37 between belts 34 and 36 opens. When lifting carriage 51 is driven upward, the gap 37 closes until the upper line of transport belt 36 presses from below against the line 5 that is to be transported. The spring mount of sleeves 54 assures a uniform pressure applied between belts 34 and 36 against line 5 and an equalization thickness with lines of different thickness and fluctuations in the thickness of one line.

To change line 5, belt 36 is pulled downward by lifting device 43, and the line previously drawn out for cutting is clamped with the clamping device in beams 6 and 7. Then the storage device is pivoted into position until the next line 5 that is to be cut enters the opened gap 37. Then gap 37 is closed again, and the clamping devices for this line are opened. In the pivoting movement, the loops that are formed assure a buffer length which can be useful in that the lines can slip out of holes 10 of beam 21 against the transport direction 4 when there is tension between the cable drum and the clamp line.

The line changer according to this invention works very rapidly. The stored lines are arranged parallel to each other and are merely pivoted on an arc across the transport direction 4. No retraction of a line is necessary nor is any other manipulation required. The free line ends are always in the position in which the line can be conveyed immediately and directly into the channel after the pivoting motion. The line changer is made of relatively lightweight components so no significant weight need be moved in pivoting the line storage.

According to this invention, the vertical distance between the axle 13 and any axle 14 is smaller than the radial distance of each axle 14 to the arc of the circle of holes 10, and each axle 14 is at the center of the circle of which the arc represents one piece. The distance between each axle 14 and the arc of the circle is preferably between two times and three times the distance between axle 13 and any axle 14. Due to this form of a rocking arrangement consisting of beams 6, 7, 21, supporting arms 11 and 12 as well as axles 13 and 14 only short distances are necessary in the direction of double arrow 18 in order to create relatively large distances in pivoting the lines in the arc. Furthermore, relatively low weights must be accelerated and braked, and space savings are relatively great in comparison with devices that move the lines linearly, for example.

According to a special version of this invention, the cutting device 3 which follows the line changer consists of a cutting device 60 and a clamping device 61 which work together in such a way that the piece of line 5 that is to be cut is secured during the cutting operation until it is sent by a transport mechanism (not shown) to an automatic finishing machine or some other processing station.

Cutting device 60 is driven by a drive shaft 62 which is mounted in a fixed position and rotates in the direction of arrow 63 and its axis of rotation **62*a* preferably runs parallel to the longitudinal extent of line 5. An eccentric pin 64 is provided on one end of shaft 62 to create a crank drive and it in turn carries a pusher rod 66 by way of a hinged head 65 and this rod is in turn connected by hinged head 67 to a pivot arm 68. Pivot arm 68 is mounted at one end of a pivot axle 69 that is mounted in a stationary position parallel with drive shaft 62 in an approximately radial arrangement. At its other end, pivot axle 69 has another pivot arm 71 also in radial alignment, and the two pivot arms 68 and 71 are arranged in an approximately V-shaped form with respect to each other as seen in the axial direction of pivot axle 69. Pivot arm 71 is connected by hinged head 72, pusher rod 73 and another hinged head 74 to a slide 75 which is mounted so it can move longitudinally at right angles to line 5 and in the direction of double arrows 76 in a guide 77. Slide 75 is designed approximately in the shape of an elongated rectangle, and hinged head 74 of pusher rod 73 is mounted in a fork-shaped recess 78 so it can be pivoted at one end of slide 75. Slide 75 has a cutting blade 81 with a V-shaped blade 82 on the end opposite hinged head 74, and this blade works like shears together with the opposing blade (not shown) in the holes 10 of beam 7 for cutting line 5**.

Pivot arm 68 in the version shown here is longer than pivot arm 71, so the movement of connecting rod 66 is geared down in transmission over connecting rod 73 to slide 75. Adjustability of the two limit positions of the back-and-forth movement of slide 75 and thus the exact cutting action is assured by the fact that the length of connecting rods 66 and 73 is variable due to the screwed-on hinged heads 65, 67 and 72, 74. It is expedient for the connecting rods 66, 73 to have a right-handed thread 83 at one end and a left-handed thread 84 at the other end as well as a counter nut 85 for each hinged head 65, 67, 72, 74.

Clamping device 61 is also driven by drive shaft 62 which for this purpose is connected by a toothed belt 90 with a stationary mounted shaft 91 which is arranged above the drive shaft 62 and parallel with it and thus also rotates in the direction of arrow 63. At its end opposite toothed belt 90, shaft 91 has two cams 92, 93 each of which has a pivot arm 94, 95 forming a tangent to its periphery. It is expedient that pivot arms 94, 95 have rotating rolls 96, 97 at each end and the axles are parallel to shaft 91.

Pivot arms 94, 95 form a tangent to cams 92, 93 on diametrically opposite sides. The two pivot arms 94, 95 preferably connect in one piece with the same pivot body 98 which is mounted so it can pivot by means of a stationary pivot axle 99 parallel to shafts 62 and 91. On the side opposite pivot arms 94, 95, the approximately square-shaped pivot body 98 has a finger 101 which has a pin at one end or preferably a roll 102 with an axis of rotation parallel to shaft 91. Finger 101 is engaged with this roll 102 with a clamping slide 103 which is guided so it can move in a plane at right angles to the transported line 5. Two guide rails 104 are mounted on two opposite vertical sides of slide 75 of cutting device 60, e.g., they may be bolted on and run vertically upward forming a gap 105 between them to hold clamping slide 103. To receive roll 102, clamping slide 103 has a rectangular recess 106 formed so it is open at the edge in the direction of finger 101. Clamping slide 103 consists of a flat material whose thickness corresponds to the gap 105 between guide rails 104. On the side opposite recess 106, clamping disk 103 has a clamping finger 107 which is mounted so it can pivot about an axle 108 that is parallel to line 5. Clamping finger 107 is aligned obliquely downward in such a way that its end 109 is above the line 5 that is to be cut to length. Clamping finger 107 has an extension 111 opposite end 109. A spiral compression spring 112 is arranged between clamping slide 103 and the extension 111 of clamping finger 107.

The cutting device operates as follows. The line 5 that is to be cut is guided by transport device 2 through a hole 10 in beam 7 and enters the area between cutting blade 81 and the opposite blade (not shown). However, before line 5 is cut, it is held securely by clamping finger 107, namely between the end 109 of finger 107 and the end of slide 75 which is behind blade 81. Then the cut is executed by the movement of slide 75.

Figure 2:
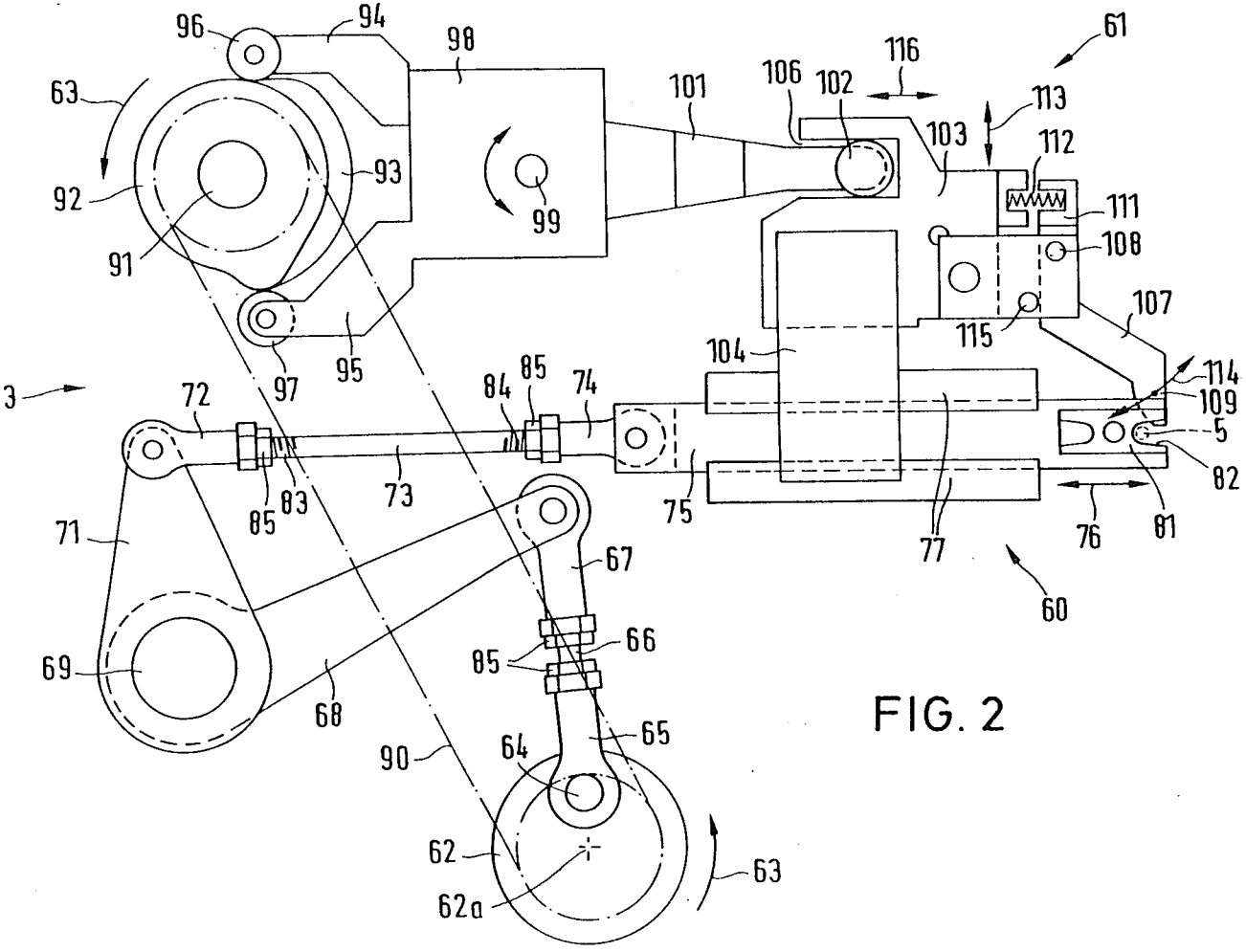
FIG. 2 shows a view in the direction of arrow II in FIG. 1.

Starting from the position of the upper dead point of crank drive 62, 64 shown in the figure, shaft 62 rotates in the direction of arrow 63. This does not create any mentionable movement of connecting rod 66 in the first 10° to 15° of rotational movement, so slide 75 executes only a slight movement and line 5 is not yet cut. During the first 10° to 15° of the rotational movement of drive shaft 62, however, cams 92, 93 are also rotated about the same angle. Due to the selected shape of cams 92, 93 with relatively steep sides, there is already a pivoting movement of pivot body 98 through pivot arm 94 during the first 10° to 15° of rotation, so finger 101 pushes clamping slide 103 downward by way of roll 102 (see double arrow 113). In this way, the end 109 of clamping finger 107 is moved in the direction of slide 75 so line 5 is secured by clamping. The clamping hold takes place due to the pivoting motion of clamping finger 107 (see double arrow 114) and the arrangement of the spiral compression spring 112 and always takes place with a predetermined pretension, and a stop 115 limits the pivoting motion of clamping finger 107 in the starting position shown in FIG. 2. Only after the line is held in the manner described here does the drive shaft 62 rotate further causing an increase in the pivoting motion of pivot arms 68 and 71 by way of the connecting rod 66 and a movement of slide 75 by way of connecting rod 73 to cut line 5, and clamping slide 103 is also entrained in the movement of slide 75 which is indicated by the double arrow 116. The cut line segment is held until it is caught by a transport device (not shown) and transported further. This is also achieved by the shape of cams 92, 93, so clamping slide 107 is shifted upward only at the proper moment in each case due to a reverse pivoting motion of pivot body 98 over pivot arm 95 and thus releases line 5.

I claim:

1. Process for changing and storing electric lines especially for cutting a line to length and equipping cut line segments with electric connectors especially in an automatic cable finishing machine with lateral transport of the cut line segments with endless belts, wherein several different lines each drawn off from a cable drum are carried in parallel side by side so the lines are spaced some distance apart on a circular arc having a culmination point at its apex, and the lines are pivoted together on the arc to permit changing from one line to another until a predetermined line is positioned at the culimination point of the arc.

2. Process according to claim 1, wherein the lines that are not to be cut to length are held together.

3. Process according to claim 2, further comprising the step of forming a loop in the line between the holding and the cable drum.

4. Process according to claim 3, wherein each line is supported at two locations spaced one from the other and clamped, and the loop is formed before one of the support locations.

5. Process according to claim 3, wherein each line is stored unclamped before the loop.

6. Process according to claim 4, wherein the unclamped line that is to be cut to length and is positioned in the culmination point of the arc is gripped with a transport device between the two support locations and is transported in cycle toward a cutting device.

7. Process according to claim 6, wherein the cut line segment is held so it is clamped for the period of time from before beginning the cutting operation until further transport of the cut line segment.

8. Device for changing electric lines and for cutting a selected line of plural lines to length in an automatic cable finishing machine with lateral transport of the cut line segments with endless belts to permit changing from one line to another, comprising a line storage device with storage locations for lines spaced a distance apart on an arc of a circle that runs across the transport direction of a line that is to be cut, and means for mounting the storage device so the storage device can pivot back and forth in the direction of the arc.

9. Device according to claim 8, wherein the storage device comprises at least two convex beams that project upward and are of the same length positioned one after the other in the transport direction of the line to be cut, with a distance between the convex beams forming an interspace, a row of holes in each beam on an arc of a circle with said holes extending in the transport direction with a lateral distance apart, and the holes of the row on a first one of the convex beams being aligned with the holes of the row on a second one of the convex beams.

10. Device according to claim 9, wherein all the holes have the same diameter.

11. Device according to claim 9, wherein a supporting arm is arranged at each free lower end of the convex beams, each supporting arm is aligned in a V shape to converge downward, and a separate pivot arm connected to each of the converged supporting arms extends downwardly therefrom.

12. Device according to claim 11, wherein the pivot arms each have a free lower end area, the pivot arms are connected to each other by a horizontal pivot axle mounted so it can rotate in the end areas, and comprising a short bearing axle parallel to the pivot axle and at right angles to each pivot arm above the pivot axle at a distance from the former, and a stationary bearing foundation engaging and mounting the bearing axle for rotation.

13. Device according to claim 12, wherein the pivot axle passes through a block connected to a coupling on which a drive mechanism acts to convey a pivoting movement about the bearing axle to the storage device.

14. Device according to claim 9, wherein in front of the beams and apart from the beams, there is a third beam which likwise has continuous holes in a row of holes.

15. Device according to claim 14, further comprising one support running parallel to the transport direction on each of the two supporting arms of the first beam at the same location, and a short supporting arm running upwardly from each support at a right angle to a free end of the third convex beam at a free end of each support.

16. Device according to claim 9, wherein the first and second beams are equipped with clamping devices for each hole therein.

17. Device according to claim 16, wherein each clamping device has a bolt which is supported in the beam and which projects from above into the corresponding hole, whereby pressing the bolt against the respective line clamps that line.

18. Device according to claim 14, further comprising a loop-forming device mounted in predetermined relation to the interspace, and a drive mechanism operative to move the loop-forming device up and down in the vertical plane in which the culmination point of the arcs is located.

19. Device according to claim 18, wherein the loop-forming device has a rotating wheel whose running surface is wedged and whose axle is horizontal and at right angles to the transport direction of the line to be cut.

20. Device according to claim 9, further comprising a transport device for a given line to be cut and disposed in the interspace between the first and second beams.

21. Device according to claim 20, wherein the transport device has an upper endless transport belt guided over a first set of rolls and a lower endless transport belt guided over a second set of rolls and positioned beneath the upper endless transport belt, such that the lower strand of the upper transport belt forms a gap with the upper strand of the lower transport belt, the transport belts are aligned in the transport direction of the line, and the gap is in the plane of the line to be cut and at the culmination of the arc of the convex beams.

22. Device according to claim 21, wherein the upper transport belt and the lower transport belt are operative to be driven at the same velocities.

23. Device according to claim 22, further comprising a motor driving a gearwheel that sits on an axle of a roll in the first set of rolls by means of a toothed belt, such that the axles of the rolls are mounted for rotation.

24. Device according to claim 22, wherein rotational drive is transmitted to the lower transport belt by a gearwheel on one of the axles of the first set of rolls and meshing with a gearwheel on one of the axles of the second set of rolls.

25. Device according to claim 21, wherein the second set of rolls of the lower transport belt is positioned on a bearing independent of the bearing of the first set of rolls of the upper transport belt and connected to a lifting device mounted for up and down movement.

26. Device according to claim 25, wherein the lifting device has two vertical parallel columns spaced a distance apart from each other and spaced a distance from the lower transport belt, each column being mounted in a bearing foundation, the columns both passing through guide bushes connected to each other by way of a connecting plate, forming a lifting carriage.

27. Device according to claim 26, further comprising a hole in the connecting plate for driving the lifting carriage, and a cam disposed in the hole and rotatable about a horizontal axis to displace the connecting plate.

28. Device according to claim 27, wherein the connecting plate hole and the cam are coordinated dimensionally in such a way that a rotating movement of the cam causes an up-and-down movement of the lifting carriage.

29. Device according to claim 26, further comprising a bearing arm extending from each guide bush in the direction of the lower transport belt, a third vertical column in a free end area at a lower portion of each bearing arm, a round sleeve inverted over the third column and having a ring-shaped collar at the lower end, a spiral compression on the third column between the collar and the lower bearing arm, each sleeve passing freely through a hole in the upper bearing arm, and the axle of a roll of the second set of rolls mounted at an upper free end of each sleeve.

30. Device according to claim 8, wherein the line storage device includes a line cutting device spaced therefrom in the transport direction of the line t be cut, and the line cutting device comprises a cutting mechanism and a clamping device that work together with the cutting mechanism to hold the piece of line being cut during the cutting operation and until further transport of the cut line segment.

31. Device according to claim 30, wherein the cutting mechanism has an elongated slide with a cross section which is guided to move at right angles to the line, and further comprising a cutting blade at one end of the slide in the area of the line, and the other end of the slide being connected by a first connecting rod to a crank drive.

32. Device according to claim 31, wherein the crank drive comprises a drive shaft parallel to the line and having an eccentric pin on which an end of a second connecting rod acts, the other end of said second connecting rod being connected to a first swivel arm attached to a stationary pivot axle parallel to the drive shaft, and a second swivel arm is connected to the end of the first connecting rod that is opposite the elongated slide.

33. Device according to claim 32, wherein the drive shaft is connected by a toothed belt to a shaft of the clamping device that is fixedly mounted in a position parallel to the drive shaft, such that the shaft of the clamping device has two coaxially positioned second and third cams side by side with a first and a second pivot arm of a pivot body, the pivot body being mounted to pivot about a stationary pivot axle parallel to the shaft of the clamping device, and said pivot arm is in tangential contact with diametrically opposed sides of the second and third cams, the pivot body having a first finger on the side opposite the pivot arms and the finger meshing with a clamp slide guided to move in a plane at right angles to the transport direction of the line to be cut, the clamp side having a second clamping finger positioned in such a way relative to the cutting device slide that the clamp slide is moved by a movement of the pivot body due to the rotation of the second and third cams, and the line is clamped between the end of the second clamping finger and the cutting blade end of the slide.

34. Device according to claim 33, wherein the first and second pivot arms have a third set of rolls for tangential bearing on the second and third cams and the third set of rolls is mounted to rotate about axles parallel to the stationary pivot axle.

35. Device according to claim 33, wherein the cutting device slide has guide rails that extend vertically upward on vertical longitudinal sides of the slide, forming a gap between the guide rails to receive and guide the clamping slide.

36. Device according to claim 33, wherein the clamping slide comprises a flat body whose thickness is adapted to the gap between the guide rails and which has a recess that is open at the edge in the direction of the second clamping finger, and a second roll mounted on the first finger to rotate about an axle parallel to the pivot axle on the first finger, the second roll engaging the recess to move the clamping slide in response to the pivoting motion of the pivot body.

37. Device according to claim 33, wherein the second clamping finger is mounted to pivot about an axle parallel to the line at the clamping slide.

38. Device according to claim 33, wherein the second clamping finger has an extension opposite said end, and further comprising a spiral compression spring positioned between this extension and the clamping slide.

39. Device according to claim 33, wherein the drive shaft and the shaft of the clamping device rotate relative to each other in such a way, and the curved shape of the second and third cams is designed in such a way, that the line is held in a clamping hold before being cut and until it is transported further.

* * * * *

UNITED STATES PATENT AND TRADEMARK OFFICE

CERTIFICATE OF CORRECTION

PATENT NO. : 4,774,761

DATED : February 4, 1988

INVENTOR(S) : RUDOLF REINERTZ

It is certified that error appears in the above-identified patent and that said Letters Patent is hereby corrected as shown below:

CHANGE OF NAME OF THE ASSIGNEE, AS PRINTED AT [73] ON THE FRONT PAGE OF THE PATENT, TO --GROTE & HARTMANN GmbH & CO. KG--.

Signed and Sealed this

Twenty-third Day of May, 1989

*Attest:*

*Attesting Officer*

DONALD J. QUIGG

*Commissioner of Patents and Trademarks*